US005277174A

United States Patent [19]

Schmidhauser

[11] Patent Number: 5,277,174

[45] Date of Patent: Jan. 11, 1994

[54] SCALP MASSAGER

[76] Inventor: Albert Schmidhauser, Rue Francois-le-Fort 4, 1206 Geneva, Switzerland

[21] Appl. No.: 766,172

[22] Filed: Sep. 23, 1991

[30] Foreign Application Priority Data

Sep. 28, 1990 [CH] Switzerland ..... 3124/90

[51] Int. Cl.[5] ..... A61H 1/00

[52] U.S. Cl. ..... 128/36

[58] Field of Search ..... 128/44-46; 128/34-36; 128/24.2, 24 R, 39, 32; 128/49, 52, 62 R

[56] References Cited

U.S. PATENT DOCUMENTS

| | | | |
|---|---|---|---|
| 2,914,065 | 11/1959 | Cory | 128/45 |
| 3,763,853 | 10/1973 | Jochiminski | 128/36 |
| 4,380,230 | 4/1983 | Williams | 128/49 |
| 4,506,659 | 3/1985 | Chester | 128/52 |
| 4,765,316 | 8/1988 | Marshall | 128/36 |
| 4,825,853 | 5/1989 | Iwamoto | 128/34 |

FOREIGN PATENT DOCUMENTS

| | | |
|---|---|---|
| 0044107 | 1/1982 | European Pat. Off. . |
| 0215519 | 3/1987 | European Pat. Off. . |
| 621935 | 11/1935 | Fed. Rep. of Germany . |
| 2300600 | 7/1974 | Fed. Rep. of Germany . |
| 2814727 | 10/1979 | Fed. Rep. of Germany . |
| 3537211 | 4/1986 | Fed. Rep. of Germany . |
| 2462906 | 2/1981 | France . |
| 2623393 | 5/1989 | France . |
| WO88/01500 | 3/1988 | Int'l Pat. Institute . |
| 557679 | 1/1975 | Switzerland . |
| 649210 | 5/1985 | Switzerland . |
| 656798 | 7/1986 | Switzerland . |
| 663537 | 12/1987 | Switzerland . |
| 667990 | 11/1988 | Switzerland . |
| 676546 | 2/1991 | Switzerland . |

*Primary Examiner*—Robert A. Hafer
*Assistant Examiner*—David J. Kenealy
*Attorney, Agent, or Firm*—Young & Thompson

[57] ABSTRACT

A scalp massager comprising a helmet (1) is provided with three first fixed contact points (5) contacting the scalp of the user located in the vicinity of the summit of the helmet. It comprises further three second contact points (8) one in the frontal zone of the helmet and the other ones in the pariéto-temporal zones of said helmet, these second contact points comprising an inflating pump (17), and a valve (18) permitting to apply them against the scalp with an adjustable, determined, pressure. Finally, the helmet comprises further an eccentric (26) driven in rotation by a motor.

7 Claims, 3 Drawing Sheets

SCALP MASSAGER

BACKGROUND OF THE INVENTION

The favorable effects of the massage of the scalp are well known. They increase the growth of hairs or avoid their falling down. Furthermore the massage of the scalp causes a relaxation, a wealthy sensation and enables one to efficiently act against stress.

Different scalp massaging apparatuses are complicated to manufacture or difficult to use.

The document WO 88/01500 describes a scalp massager comprising a strap along which massaging blocs can slide. Each massaging bloc comprises a vibration generator transmitting vibrations to a supple wall intended to be in contact with the scalp. By modifying the position of the strap with respect to the head of the user and of the massaging blocs along the strap one obtains a massage of the totality of the scalp. Such a device is inadequate since it requires a plurality of complex massaging bodies comprising a vibration generator, and is of a long and fastidious use since it is necessary to displace this strap as well as the bloc successively a very great number of times to obtain a complete massage.

The document CH 663.537 describes a scalp massager comprising a helmet constituted by an outside envelope and an inside envelope which are displaceable the one with respect to the other and under the action of driving means. The internal envelope is provided with fingers pneumatically applied against the scalp of the user causing a massage of it, or of certain points of this scalp, when they are driven into the movements of the internal envelope, the external envelope of the helmet being fixed on the head of the user. This apparatus is complicated to manufacture and above all to use since it is necessary, in view of the fact that the outside envelope of the helmet is fixed to a support, for the user to keep his head in a determined position during all the time of the massage.

The document CH 557.679 describes a scalp massager comprising a helmet intended to be fixed on the head of the user to a frontal strap. This helmet is provided with a plurality of fingers applied against the scalp of the user and driven by a driving system into opposed movements. Here also the number of fingers and their driving render the apparatus complex and only a restricted number points of the scalp can undergo the massage.

OBJECT OF THE INVENTION

The aim of the present invention is the realization of a scalp massager which is simple to manufacture and thus has a reduced cost, which permits to act on the whole scalp in an automatic manner without intervention of the user or of a third person, which does not necessitate any intervention during its use and which is directly fixed onto the head of the user, so that the user is free of its movements during the massage, in order for him to have other occupation during the massage time.

SUMMARY OF THE INVENTION

The massage apparatus according to the invention is characterized by the fact that it comprises a support provided with at least a first fixed point of contact with the scalp of the user located in the vicinity of the summit of the support and of three second contact points, one in the frontal zone of the support and the others in the pariéto-temporal zones of the support; by the fact that at least one of these second points of contact comprises means permitting to apply it against the scalp with a determined and/or adjustable pressure, and by the fact that the massager comprises an eccentric driven into rotation by means of a motor.

BRIEF DESCRIPTION OF THE DRAWINGS

The attached drawing shows schmematically and by way of example one embodiment of the massager according to the invention.

DETAILED DESCRIPTION OF THE INVENTION

Figure 1:
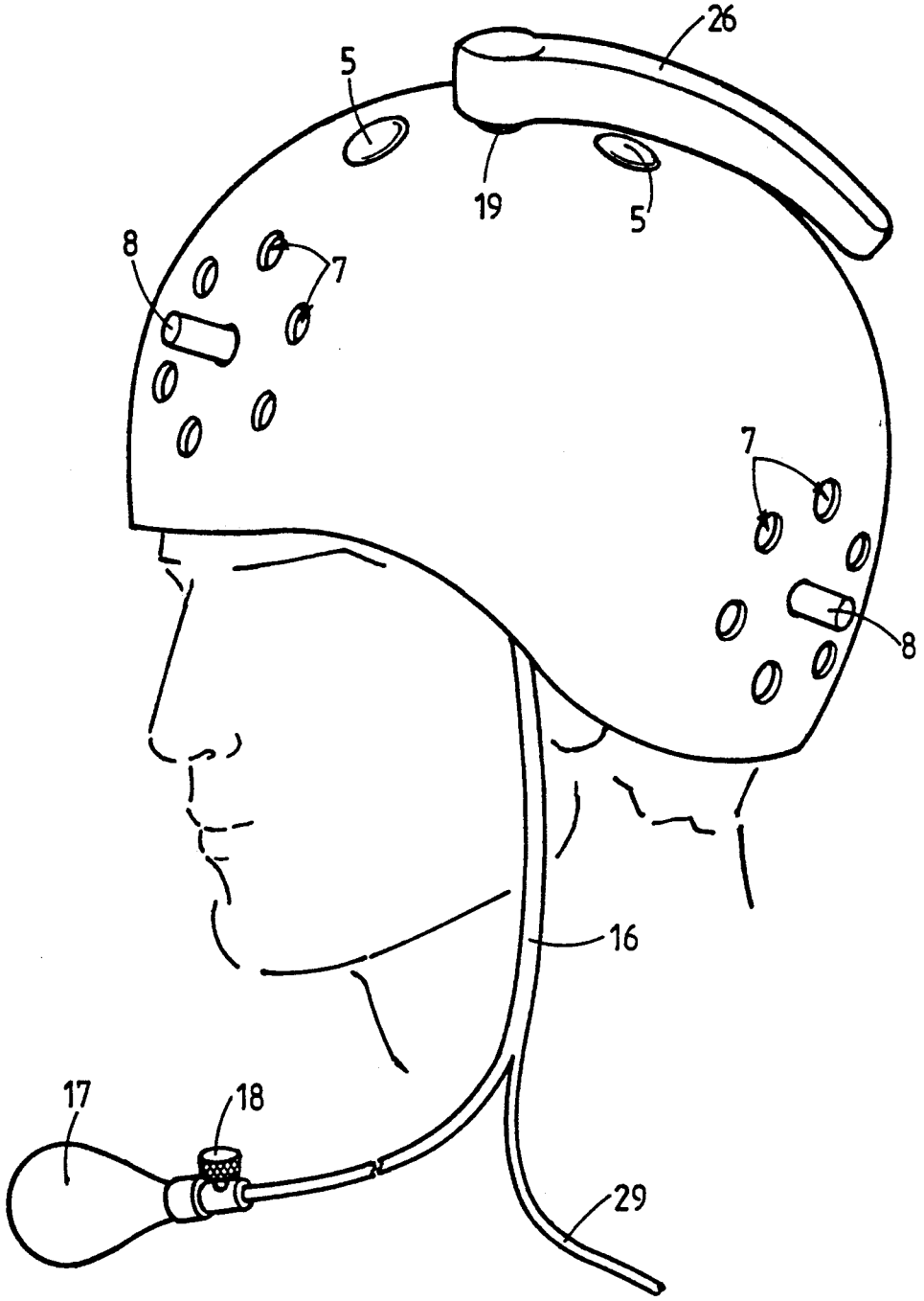
FIG. 1 is a perspective view of the device in massage position on the head of the user.
Figure 2:
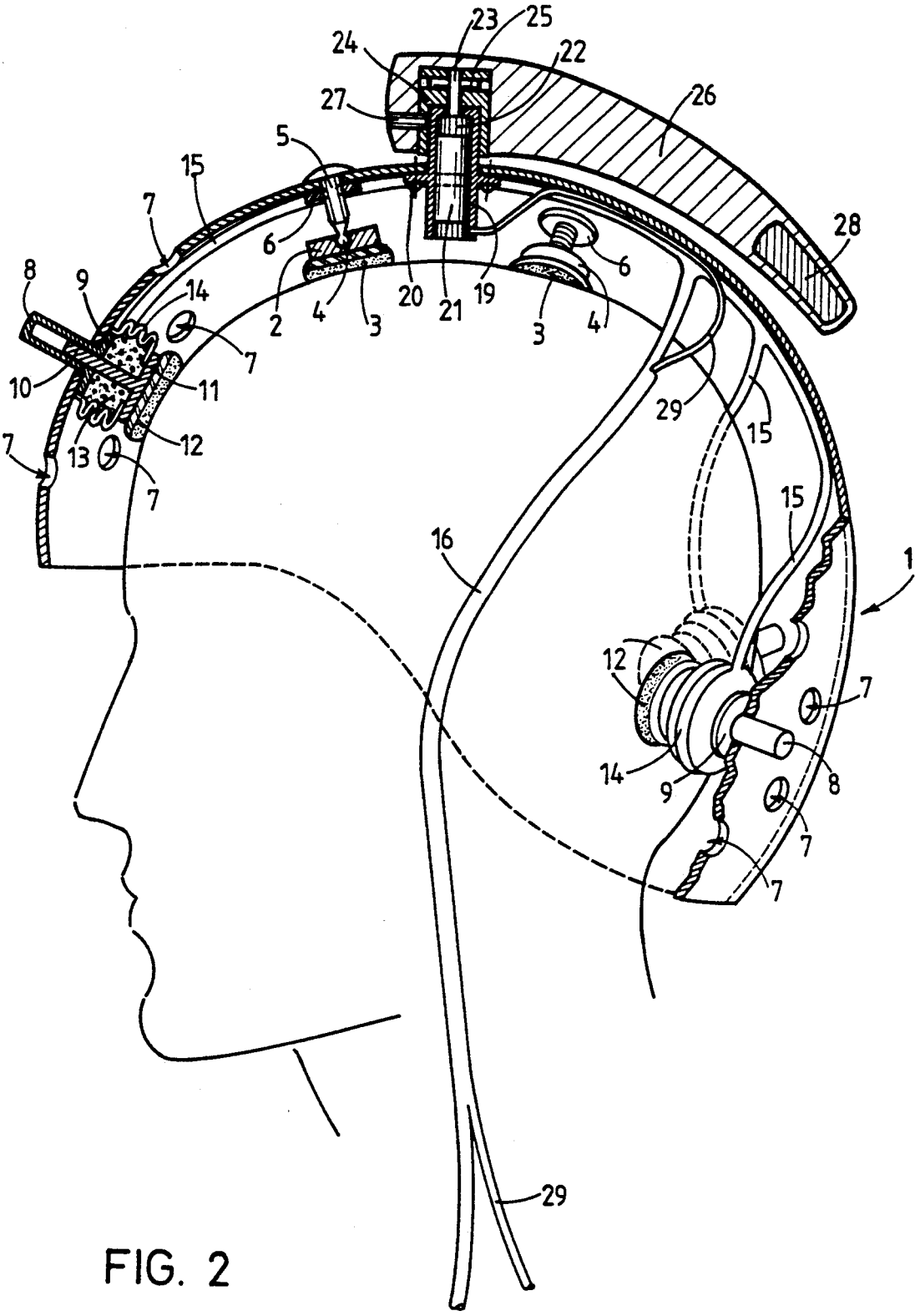
FIG. 2 is a longitudinal cross-section of the massager shown at FIG. 1.
Figure 3:
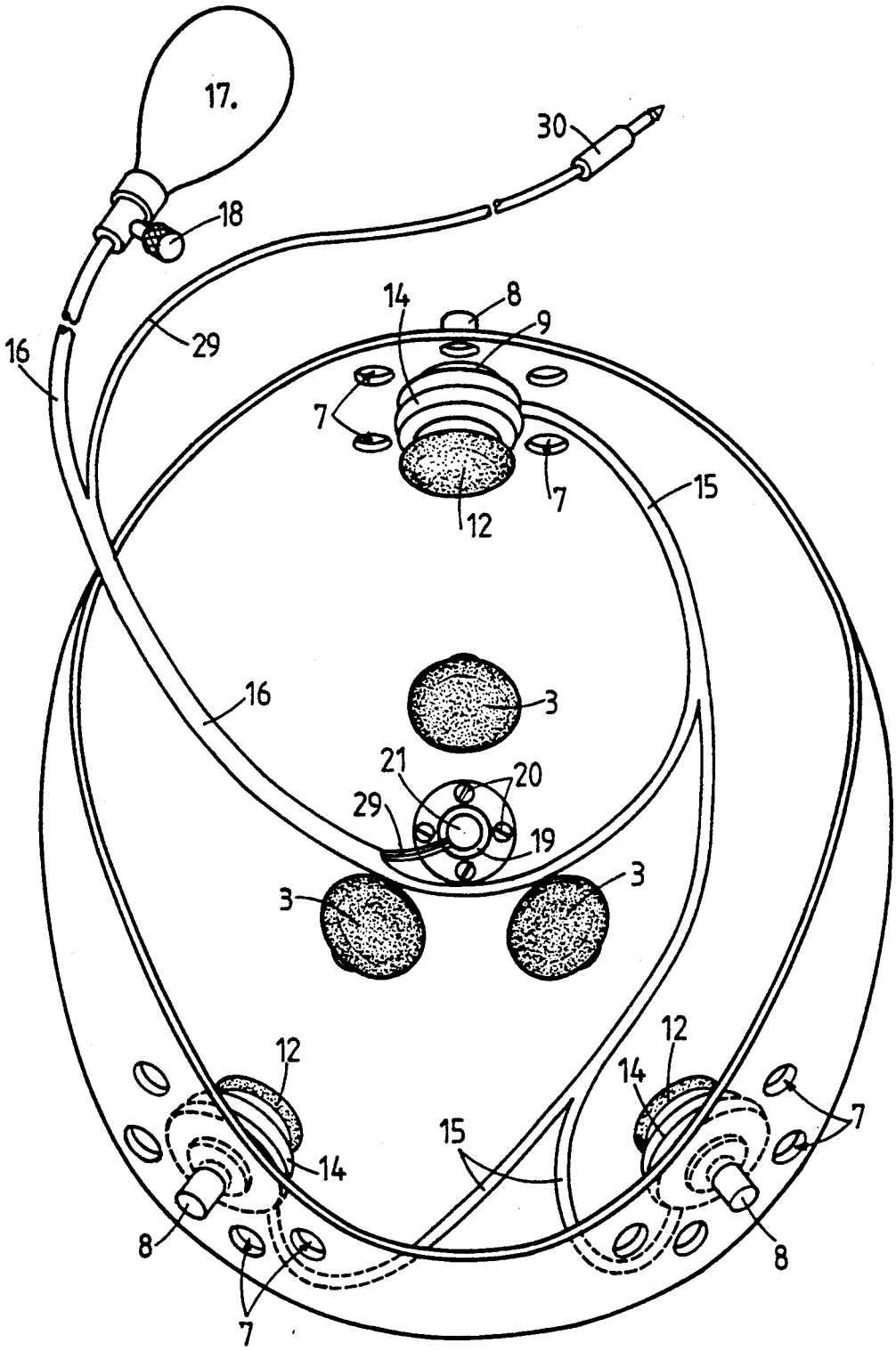
FIG. 3 is a view from underneath showing the inside of the massaging apparatus.

The hairs or scalp massaging apparatus is based on a masssaging principle which is totally different from the previous apparatuses which all use fingers or massaging means entering into contact with the scalp and animated small movements, causing localized massage zones around each of these massaging fingers.

On the contrary the present massager for the hairs or the scalp comprises a restricted number of contact points with the scalp, one to three at the summit of the scalp, one frontal and two pariéto-temporal ones which are all mounted on a same support. Means are provided to apply at least certain of these contact points, generally the frontal contact points and the two pariéto-temporal contact points against the scalp in order to fix rigidly the support to the scalp of the user.

The apparatus comprises further means permitting to drive the support into alternative and cyclic movements causing the driving of the scalp through the contact points and thus an oscillating or rotating movement with respect to the head of the user causing thus a massage of the whole scalp.

In the preferred embodiment shown the support is constituted by rigid helmet 1 in synthetical moulded material.

This helmet is provided in its central zone with three resting means or fixed contact points which can be oriented and which are disposed in triangle along the axis of the helmet. Each of these fixed points is constituted by an orientable pad 2 presenting a supple cushion 3 mounted on a ball socket 4 constituting the end of a screw 5 which crosses the helmet and cooperates with a nut 6.

The helmet is provided in its frontal zone and in its pariéto-temporal zones with bores or holes 7, seven holes in each of these zones in the example shown, intended for the fixation and the positionning in each of these threee zones of a removable contact point. At least one of these removable contact points is inflatable, in the example shown the three removable contact points are inflatable.

Each removable contact point comprises a guide constituted by a tubular element 8 driven in one of the holes 7 of one of the three zones, and said tubular element is fastened to a washer or flange 9 which rests against the internal surface of the helmet 1. Each of these removable contact points comprises further a piston, the rod 10 of which is located into the tubular element 8 and slides in it, and the frontal portion 11 of which is provided with a deformable cushion 12 intended to enter in contact with the scalp of the user.

A body 13 in resilient foam is located between the frontal portion 11 of the piston and the washer 9 of the guide. A deformable and tight bellows 14 connects this washer 9 to the frontal portion 11 of the piston creating thus a tight chamber.

Each of these three tight chambers is connected by means of a duct 15 to a pressurizing conduit 16 the free end of which is connected to an inflating pump 17 by means of a valve 18.

The helmet 1 comprises in its central portion or at its summit a hole giving access to a tubular frame 19 rigidly fixed to the helmet 1 through screws for example. This frame 19 houses an electrical motor 21, the shaft of which drives a reducer 22 and the output shaft of which 23 is fastened to a cylindrical member 24 by a pin 25. This member 24 enters into a housing of the arm 26 which is fastened to the member 24 by means of the screw 27. This arm extends approximately parallel to the outside surface of the helmet on a distance comprised between about $\frac{1}{3}$ and $\frac{2}{3}$ of the head of the helmet. The free end of this arm 26 comprises a weight 28 embeded in the material of the arm during its moulding or fixed in any other ways to said arm 26. The arm 26 and the weight 28 constitute an eccentric.

The motor 21 is fed by means of an electrical cable 29, the end of which is provided with a male plug 30 for its electrical feeding. It is evident that the electric motor 21 could also be fed by batteries or accumulators which could be located within the arm 26 for example, at the place of the weight 28.

The working of the scalp massager described is the following:

a. The user places the frontal and pariéto-temporal contact points at the location which are convenient for him by choosing one of the holes 7 of each zone to put the tubular guide 8 into it.

b. The user places the helmet onto his head, the fixed resting points 2 to 5 coming into contact with the summit of his head.

c. The user inflates the tight bellows 14 of the removable resting points 8 to 14 by means of the pump 17 to the desired pressure. This pressure must be such that it fixes the helmet onto the scalp of the user without injuring him.

d. The user connects then the feeding of the electrical motor 21 causing the driving into rotation of the arm 26 around the helmet 1. This rotation of the arm, thanks to the weight 28, causes oscillations on the helmet 1 which drives the scalp into its movements.

One obtains a global massage of the scalp and a disconnecting of it from the bone of the head, enhancing the blood circulation and the release of the user.

The helmet 1 is fixed to the head of the user and the feeding of the motor is able to be done through accumulators, which are incorporated into the arm 26. The user is free of its movements and can displace himself during the massage.

Furthermore, this apparatus is simple and of low cost for its manufacture due to the restricted number of contact points and due to the fact that these contact points are static and have not to be driven into individual movements to cause the massage but are dependent of the helmet 1.

When the massage is terminated the user opens the valve 18 liberating the pressure of the bellows 14 enabling him to withdraw the helmet.

In variants one can provide the helmet with only one fixed contact points which will be for example fixed on the head of the housing 19 extending within the helmet 1.

Only one or two of the removable contact points 8 to 14 could be inflatable. Furthermore, in a simplified variant the contact points 8 to 14 could present only one possible position with respect to the helmet.

One can further imagine that the pressure applied to the removable contact points 8 to 14 can be obtained by-means of resilient means, springs, silent-blocs, and so on, permitting to suppress the conduits 15,16 as well as the pump 17 and the valve 18.

Most if not all elements of the apparatus are able to be made in plastic material, moulded or injected, and are thus light and cheap. Furthermore, the assembling of the whole apparatus is very simple and thus does not necessitate any precision mounting.

In order to vary the intensity of the massage it is possible to modify the speed of rotation of the arm by acting on the electrical feeding of the motor or on the ratio of the reducer. One may also act on the weight and the distance of said weight to its rotation axis.

In other variants, the arm 26 provided with its weight 28 can be replaced by an eccentric driven into rotation by the motor 21, which eccentric can present for example the shape of a disc provided with at least one perforation or a disc having a variable thickness. Any other shape or configuration being less cumbersome can be provided for that eccentric.

I claim:

1. Scalp massager comprising: a rigid helmet provided with at least one first fixed contact point with the scalp of a user located in the vicinity of the summit of the helmet; three second contact points, one of said second contact points located in a frontal zone of said support and the others in pariéto-temporal zones of said helmet; at least one of said second contact points further comprising means for applying said at least one of said second contact points against the scalp at a predetermined and adjustable pressure; said helmet having means for permitting a selection of the position of each of the second contact points with respect to the helmet, said permitting means comprising several holes in each of the frontal and pariéto-temporal zones such that a second contact point can be moved to a different location on the helmet by engaging it with a different hole; said helmet having an outer surface and further including means for driving the helmet into alternative and cyclic movements with respect to the head of the user so as to effect a massage of the entire scalp, said means for driving comprising an eccentric driven into rotation by a motor, said eccentric comprising an arm extending approximately parallel to said outer surface, and said arm being provided with a weight at an end thereof.

2. Scalp massager according to claim 1, wherein the helmet comprises three first contact points, each of said first contact points comprising a pad provided with a supple and deformable cushion, and each of said pad being connected to the helmet by means of a socket joint.

3. Scalp massager according to claim 1, wherein said three second contact points are mounted on the helmet in a removable manner.

4. Scalp massager according to claim 3, wherein each removable contact point comprises a tubular guide located in a hole of the helmet and in which a piston, provided with a supple cushion, slides.

5. Scalp massager according to claim 4, wherein a resilient member is mounted between the guide and the piston of the removable contact points tending to displace the piston towards the inside of the helmet.

6. Scalp massager according to claim 5, wherein a bellows connects the guide to the piston creating a tight chamber, said chamber being fluidly connected to pressurizing means via a conduit.

7. Scalp massager according to claim 1, wherein the motor is mounted into a cylindrical housing fixed to the helmet at its summit, and the motor drives said arm via a reducer.

* * * * *